US009133694B2

(12) United States Patent
Lyashkov et al.

(10) Patent No.: US 9,133,694 B2
(45) Date of Patent: Sep. 15, 2015

(54) NOZZLE SELECTIVE PERFORATING JET ASSEMBLY

(71) Applicant: Schlumberger Technology Corporation, Sugar Land, TX (US)

(72) Inventors: Victor Lyashkov, Katy, TX (US); Mark Callister Oettli, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 13/667,244

(22) Filed: Nov. 2, 2012

(65) Prior Publication Data

US 2014/0124201 A1 May 8, 2014

(51) Int. Cl.

| | |
|---|---|
| ***E21B 29/06*** | (2006.01) |
| ***E21B 43/114*** | (2006.01) |
| ***E21B 43/119*** | (2006.01) |

(52) U.S. Cl.

CPC ..... *E21B 43/114* (2013.01); *E21B 29/06* (2013.01); *E21B 43/119* (2013.01)

(58) Field of Classification Search

CPC ..... E21B 29/00; E21B 29/06; E21B 41/0078; E21B 43/114; E21B 43/119

USPC ..... 166/308.1, 177.5, 297, 298, 55, 55.6, 166/55.7, 55.8

See application file for complete search history.

(56) References Cited

U.S. PATENT DOCUMENTS

| | | | | |
|---|---|---|---|---|
| 5,392,862 | A * | 2/1995 | Swearingen | 166/386 |
| 6,491,097 | B1 | 12/2002 | Oneal et al. | |
| 6,564,878 | B2 | 5/2003 | Williams et al. | |
| 6,668,948 | B2 | 12/2003 | Buckman, Sr. et al. | |
| 6,752,685 | B2 | 6/2004 | Ulrich et al. | |
| 7,090,020 | B2 | 8/2006 | Hill et al. | |
| 7,159,660 | B2 | 1/2007 | Justus | |
| 7,168,491 | B2 | 1/2007 | Malone et al. | |
| 7,225,869 | B2 | 6/2007 | Willett et al. | |
| 7,337,844 | B2 | 3/2008 | Surjaatmadja et al. | |
| 7,497,259 | B2 | 3/2009 | Leising et al. | |
| 7,571,766 | B2 | 8/2009 | Pauls et al. | |
| 7,631,698 | B2 | 12/2009 | Miller et al. | |
| 7,832,481 | B2 | 11/2010 | Martindale | |
| 7,963,332 | B2 | 6/2011 | Dotson et al. | |
| 8,066,059 | B2 | 11/2011 | Ferguson et al. | |
| 2008/0179060 | A1 * | 7/2008 | Surjaatmadja et al. | 166/298 |

* cited by examiner

*Primary Examiner* — Brad Harcourt

(74) *Attorney, Agent, or Firm* — Michael L. Flynn; Timothy Curington; Robin Nava

(57) ABSTRACT

A downhole hydraulic tool employing multiple nozzles in a selectable fashion from an oilfield surface. At least one of the nozzles of the tool is equipped with a burst disk such that fluid pressure directed from the surface may be utilized in activating the nozzle. The pressure may be driven to exceed a predetermined level for sake of the activating by way of sealing off access to other nozzle(s) therebelow, for example, by way of standard ball drop techniques. Thus, nozzle selectivity may be taken advantage of when a first nozzle wears out without requiring time consuming removal of the tool from the well for sake of remedial repairs or replacement.

21 Claims, 6 Drawing Sheets

NOZZLE SELECTIVE PERFORATING JET ASSEMBLY

BACKGROUND

Exploring, drilling and completing hydrocarbon wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, today's hydrocarbon wells often include deviated or horizontal sections aimed at targeting particular underground reserves. Indeed, at targeted formation locations, it is quite common for a host of lateral legs and perforations to stem from the main wellbore of the well toward a hydrocarbon reservoir into the surrounding formation.

The above described perforations are formed and effectively completed by a series of applications that begin with perforating the well wall. So, for example, a casing defining the well may be perforated by a series of projectiles directed at a targeted location by way of a perforating gun. The gun itself may be equipped with conventional charges for powering the projectiles, with the application itself directed over standard wireline running from the oilfield surface.

Perforating in this manner generally takes place in a zone by zone fashion. That is, for sake of effective management, production regions are divided into 20 to 40 or more zones, often ranging from 3 feet to 50 feet or so apiece. Thus, over the course of perforating a well, one zone is generally perforated, followed by another, and so on. Once more, fully developing perforations for sake of enhancing recovery, requires more than the initial perforating via the perforating gun. Rather, follow-on fracturing, or "fracing", and cleanout applications are also employed. The fracturing involves pumping a fracturing fluid with solid proppant particulate to the perforated locations to provide a degree of channel stabilization. Subsequently, a cleanout application may be employed to remove excess debris and particulate following the perforating and fracturing.

Unfortunately, the step by step process of perforating, fracturing and cleanout is performed on a zone by zone basis. So, for example, following the perforating, the gun may be removed and other fracturing and cleanout equipment lowered into position for these subsequent applications. Afterwards, the entire process of delivering and removing the various pieces of equipment may be repeated for each and every zone. In fact, each zone may even be isolated in advance of perforating and fracturing, thus adding further layers of complexity and time to the overall process.

In order to streamline the above described process of perforating and fracturing various downhole zones, coiled tubing perforating equipment may be utilized. More specifically, a hydraulically driven coiled tubing assembly may be outfitted with a jetting tool and other features capable of performing each of the various perforating, fracturing and cleanout functions. That is, the coiled tubing may be advanced to the downhole perforating location and the jetting tool employed to create the above described perforations. However, rather than remove the coiled tubing, it may be left in place as a fluid-based fracturing application is directed through the coiled tubing (or adjacent to it within an annulus formed between the coiled tubing and the wellbore) to the recently perforated zone. Indeed, the coiled tubing may remain in place to serve as the platform for a subsequent circulating cleanout application.

In theory, routing each of the various applications through the same bottom hole assembly (BHA) at the end of the coiled tubing would save a tremendous amount of time in terms of trips into the well. That is, after one zone is finished, the coiled tubing may be moved to the next zone and the same applications repeated through the same BHA without the need to return to the oilfield surface.

Unfortunately, the ability to fully take advantage of the coiled tubing BHA for the different applications noted above is limited by the nozzles of the jetting tool. As noted above, the BHA is outfitted with a jetting tool which utilizes nozzles in achieving the perforating at each zone. However, even the most robust of nozzles is likely to be effective for no more than about 5 to 10 perforating applications. This is due to the naturally occurring erosion which tends to enlarge the diameter of the nozzles over repeated use. As a result, after perforating and fracturing 5 to 10 zones or so, the entire coiled tubing is removed from the well so that the nozzles and/or the entire jetting tool of the BHA may be replaced. The assembly is then re-deployed for use in subsequent zones, with this process repeated until all of the perhaps 40 or more zones are fully perforated, fractured and cleaned out. Thus, the ability to attain the full advantage leaving the coiled tubing downhole throughout the perforating and fracturing of the entire well remains elusive.

In some circumstances, efforts may be undertaken to extend the effective life of the nozzle without removing the BHA. For example, as later zones are perforated, operators at the oilfield surface may increase pressure and flow rates in an attempt to compensate for increasing diameter of the eroding nozzles. However, such efforts are unlikely to extend nozzle life beyond an additional perforating application or two. Thus, as a practical matter, the operator is still likely to remove the entire BHA on multiple occasions, adding significant time and expense to overall perforating and fracturing operations.

SUMMARY

A nozzle selective perforating jet assembly is provided with multiple nozzles. A first jetting nozzle may be situated at a given location of the assembly for directing a first perforating application. Further, another nozzle may be positioned at another location for a subsequent perforating application. Once more, a burst disk may be incorporated into the other nozzle for the subsequent application so as to occlude fluid access thereto when pressure in the assembly is below a predetermined level.

DETAILED DESCRIPTION

Embodiments are described with reference to certain downhole applications conveyed by way of coiled tubing. For example, coiled tubing driven perforating, fracturing and cleanout operations are detailed within a cased well. However, other types of applications, tools and environments may be applicable. For example, embodiments of jetting tools directed at open hole environments or liners of lateral legs may be applicable. Additionally, conveyance for sake of perforating may be achieved by way of drill pipe or other tubular deployment. Regardless, the jetting tool includes multiple nozzles which may be selectively actuated via burst disk mechanics depending upon internal sealing and hydraulic pressure directed through the tool.

Figure 1:
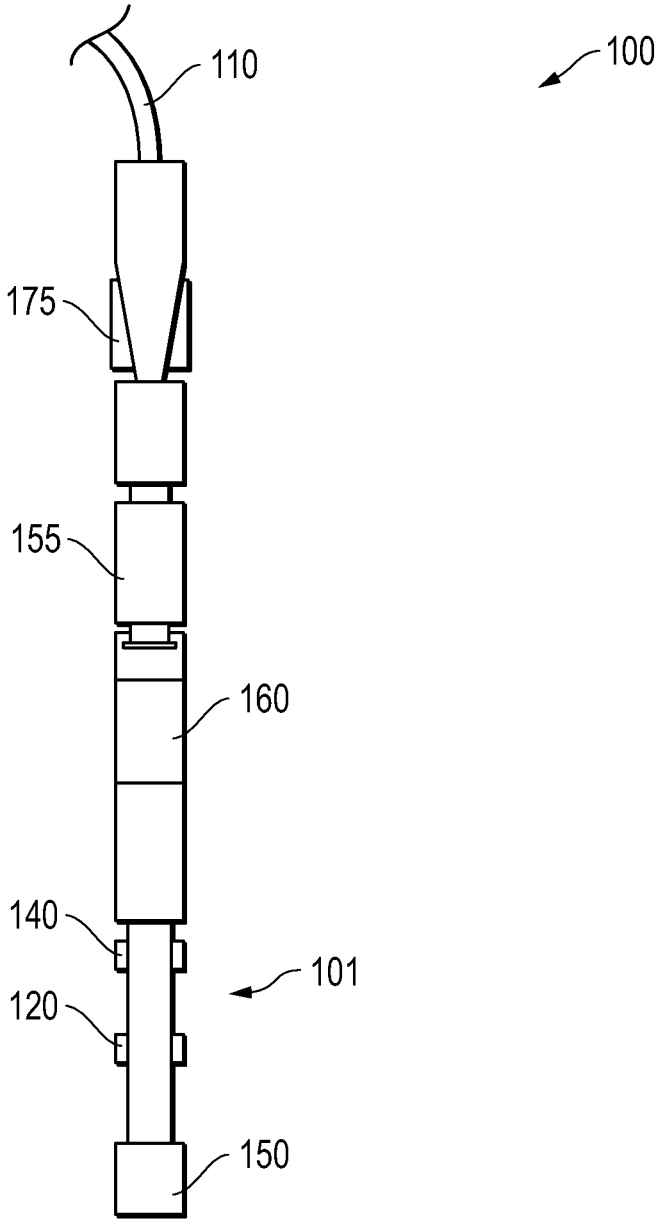
FIG. 1 is a front view of an embodiment of a nozzle selective perforating jet assembly.

Referring now to FIG. 1, a front view of an embodiment of a nozzle selective perforating jet assembly 100 is shown. The assembly 100 includes a jetting tool 101 outfitted with pairs of nozzles 120, 140. With reference to a given nozzle set (e.g. 140), the nozzles thereof appear roughly opposite one another at a particular radial depth location of the tool 101. However, in other embodiments such nozzles 140 may be staggered relative one another in terms of depth location or even located at different radial positions of the tool 101 other than 180° directly opposite one another.

The nozzles 120, 140 of the jetting tool 101 are configured to guide perforating as detailed hereinbelow (see FIG. 3A). This application involves driving an abrasive silica or sand-based slurry through coiled tubing 110 of the assembly 100 and ultimately directed through the nozzles 120, 140. More specifically regarding the embodiments depicted, however, the nozzles 120, 140 may be selectively employed through the use of burst disks 400 (see FIG. 4B). So, for example, with added reference to FIG. 4, in one embodiment, the uphole nozzles 140 may be outfitted with burst disks 400 to prevent jetting therethrough until a predetermined pressure has been attained. That is, an operator may initially direct perforating through the downhole nozzles 120 for a period of uses. However, once a determination is made that such nozzles 120 may be damaged, for example, through natural wear, they may be hydraulically shut off by way of a conventional ball drop or other suitable technique. As such, pressure within the tool 100 may then be driven up until burst disks 400 of the uphole nozzles 140 are ruptured, at which time, these nozzles 140 may then be utilized for subsequent perforating.

The above described technique of nozzle selective perforating allows the operator to use different sets of nozzles 120, 140 in succession. Indeed, in other embodiments, nozzles at more than two depth locations may be successively employed through the use of burst disks 400 as shown in FIG. 4B. Thus, with added reference to FIG. 2, an operator at an oilfield 200 need not pull the entire assembly 100 out of the well 280 each time a nozzle or nozzle set 120 wears out. Rather, the operator may simply shut off the worn out nozzles 120 and move to the next uphole set via burst disk actuation as noted above and detailed further below.

Continuing with reference to FIG. 1, the assembly 100 depicted includes a variety of additional features useful in operating a perforating jetting tool 101. For example, an anchor segment 175 may be provided for setting the assembly 100 in advance of performing tasks such as the noted perforating via the tool 101. In the embodiment shown, a compression set anchor is utilized, though other setting mechanisms may be employed. Furthermore, where oriented perforating is desired, such as within a lateral or substantially horizontal well section, swivel 155 and eccentric weighted 160 segments may be provided. Additionally, in the embodiment shown, a reverse circulation segment 150 is depicted which may be utilized in follow-on clean-out applications as detailed hereinbelow.

In addition to the above noted features, multi-cycle, coupling, isolation and other standard bottom hole assembly features may be incorporated into the assembly 100. Once more, the features may be provided in multiple and rearranged configurations. For example, multiple isolation devices may be utilized both above and below the jetting tool 101 or alternatively a single isolation device positioned above or below the tool 101.

Figure 2:
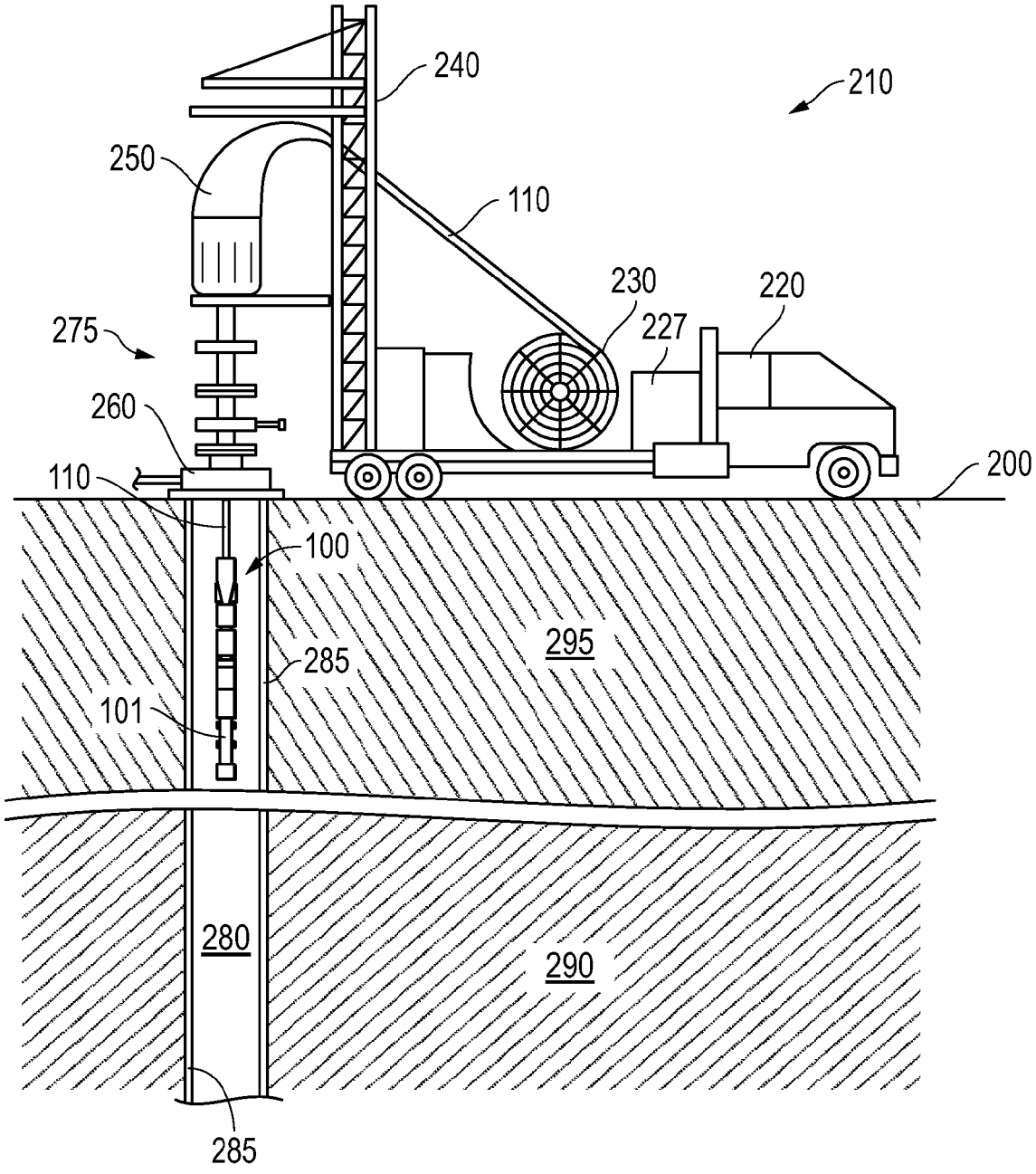
FIG. 2 is an overview of an oilfield having a well with the nozzle selective perforating jet assembly of FIG. 1 disposed therein.

Referring now to FIG. 2, an overview of an oilfield 200 is depicted with a well 280 accommodating the nozzle selective perforating jet assembly 100 of FIG. 1 therein. In this depiction, the assembly 100 is shown advancing into a well 280 and traversing various formation layers 290, 295 prior to perforation. For example, as detailed further below with respect to FIGS. 3A-3C, the tool 101 of the assembly 100 may be positioned adjacent casing 285 at one depth or another for sake of perforating and other stimulation efforts. Indeed, the well 280 may be sectioned off into various 3-50 foot or so 'zones' adjacent the different layers 290, 295, with each zone slated to undergo a series of applications as detailed with reference to FIGS. 3A-3C. Once more, the ability to leave the assembly 100 and tool 101 downhole for a maximum of different perforating applications at different zones may be of significant advantage. More specifically, with reference to FIG. 2, the tool 101 need not be pulled out of the well 280 and disassembled past various equipment described below each time a set of nozzles wears out. Rather, shut off of worn out nozzles and burst disk activation of unused nozzles may be utilized as detailed above to significant cost and time saving advantage.

In the embodiment of FIG. 2, the assembly 100 is conveyed by way of coiled tubing 110 drawn from a reel 230 at the oilfield surface 200. More specifically, a coiled tubing truck 220 is positioned adjacent the well 280 for sake of providing the reel 230 along with a pump 225, control unit 227, mobile rig 240 and other equipment. The rig 240 supports the transition of coiled tubing 110 from the reel 230 and through a gooseneck injector 250 and standard pressure control equipment 275 at the well head 260. A variety of hydraulic conveyances may be utilized in positioning the assembly 100 and jetting tool 101 in light of the hydraulic influx of jetting fluids into the well 280 and subsequent cleanout. However, the forcible injective advancement of coiled tubing 110 may be particularly useful in circumstances where the well 280 is of extended reach or includes substantially horizontal, lateral, or other tortuous well sections.

Figure 3A:
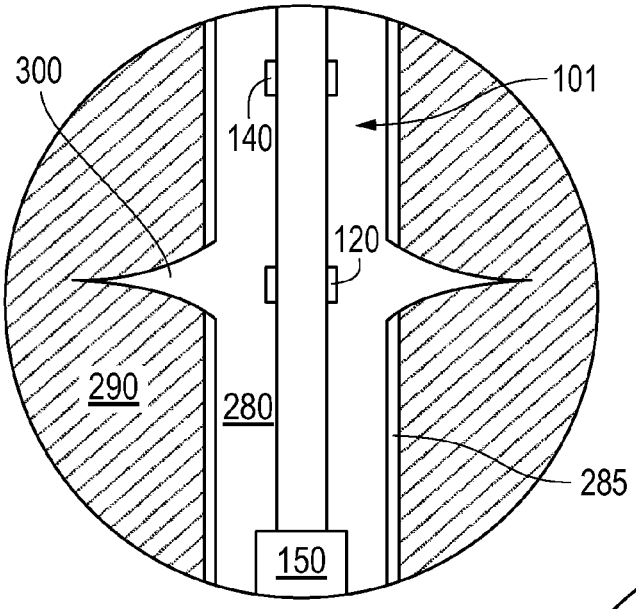
FIG. 3A is an enlarged view of a jetting tool of the assembly of FIG. 1 utilizing burst disk nozzles to form perforations in the well of FIG. 2.
Figure 3B:
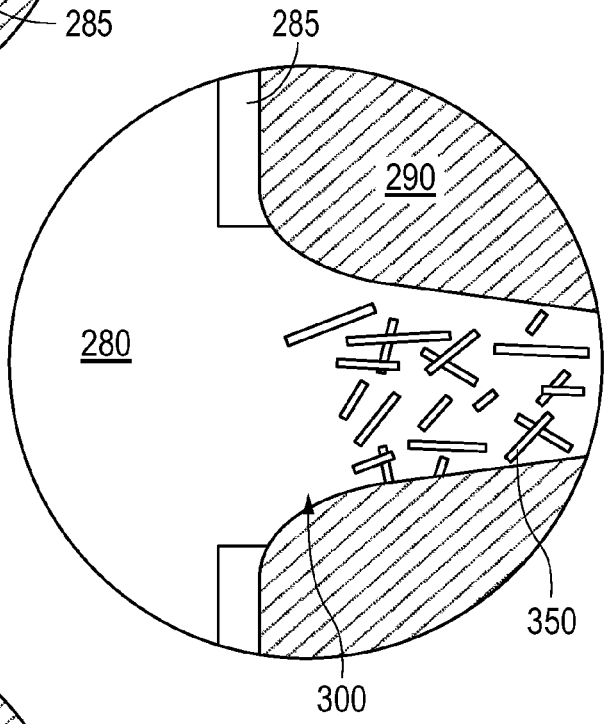
FIG. 3B is an enlarged view of a perforation of FIG. 3A following a fracturing application with the assembly.
Figure 3C:
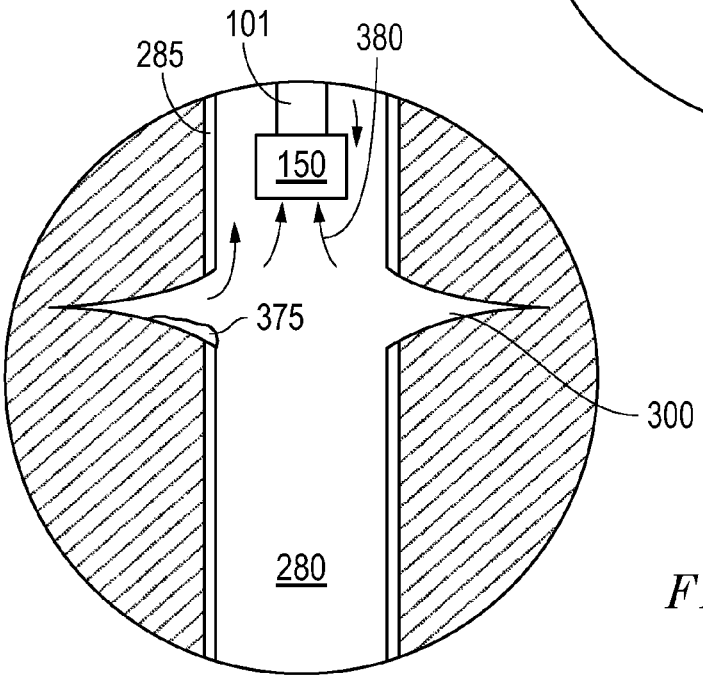
FIG. 3C is an enlarged view of the assembly of FIG. 3A during a cleanout application in the well.

Referring now to FIGS. 3A-3C, enlarged views of the jetting tool 101, and/or perforations 300 formed thereby into the adjacent formation 290, are depicted. More specifically, FIG. 3A shows the tool 101 of FIG. 1 utilizing nozzles 120 to form the noted perforations 300 in the well 280 of FIG. 2. Subsequently, the results of a fracturing application, with proppant, shown as proppant supported fibrous network 350, are depicted at the enlarged view of the perforation 300 of FIG. 3B. Finally, a cleanout application directed through the reverse circulation segment 150 of the tool 101 is shown at FIG. 3C. Notably, each of the referenced applications regarding FIGS. 3A-3C may be run through the tool 101 without the need for its intervening removal to the oilfield surface 200 (see FIG. 2).

Referring specifically now to FIG. 3A, the tool 101 may be positioned as indicated. With position confirmation via the control unit 227 of FIG. 2, the assembly 100 may be directed to anchor in place utilizing the anchor segment 175 of FIG. 1. In one embodiment, anchoring may be hydraulically achieved with a monitored pressure indicative of achieving an anchored setting. By the same token, in embodiments where zonal isolation is to be employed, isolating devices at either side of the tool 101 may also be hydraulically actuated. In either case, abrasive jetting through the initial set of nozzles 120 may now ensue so as to form the depicted perforations 300. Depending on the pressures utilized and a host of other factors, the perforations 300 may reach between a couple of inches to a foot or more into the formation 290.

In one embodiment, even the initial set of nozzles 120 are of a burst disk variety. Thus, pressure utilized in the jetting application depicted is sufficient for bursting disks incorporated into these nozzles 120 so as to initiate perforating. For example, in one embodiment, a 2,000-3,000 PSI differential is utilized in jetting through these nozzles 120. As such, where they are equipped with burst disks, a pressure rating of below about 2,000 PSI may be utilized for these particular disks. Further, in circumstances where the burst disk for one of the pair of nozzles 120 breaks but the other does not, flow rate may be increased so as to overrun the jetting of the open nozzle 120 and allow the other disk to break for opening of the other nozzle 120. So long as pressure is kept below the higher pressure rating of disks associated with uphole nozzles 140, this technique may be utilized to ensure that both downhole nozzles 120 are opened. Of course, as noted above and detailed further below, the backup or uphole nozzles 140 are also made available once the initial downhole nozzles 120 begin to show wear from the initial described perforating.

Referring specifically now to FIG. 3B, an enlarged view of a perforation 300 of FIG. 3A is shown following a fracturing application with the assembly 100 of FIGS. 1 and 2. More specifically, a proppant supported fibrous matrix 350 is shown disbursed throughout the perforation 300 so as to support subsequent hydrocarbon recovery therefrom. The fracturing application may be similar to the noted perforation. However, the fracturing fluid may be delivered at lower pressures and higher volumes, with the fluid emerging from ports other than the nozzles 120, 140. Regardless, following perforating and fracture fluid delivery, debris 375 in the area may then be cleaned out as depicted in FIG. 3C. More specifically, a conventional cleanout may be run through the reverse circulation segment 150 as noted above. Thus, the assembly 100 may be repositioned with a subsequent well zone undergoing a similar set of perforating, fracturing and cleanout procedures.

Figure 4A:
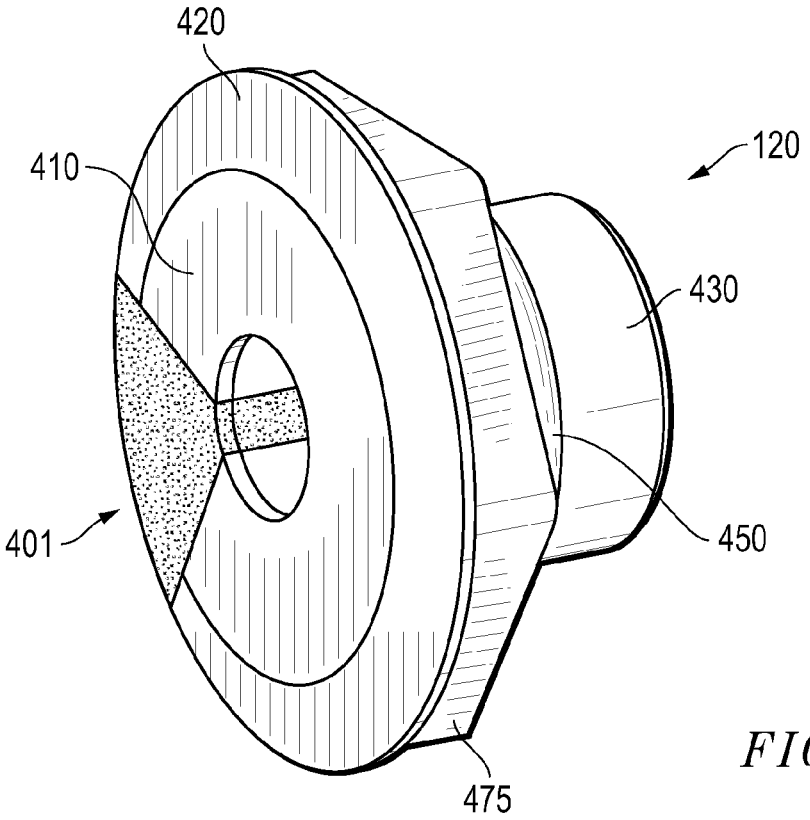
FIG. 4A is a perspective view of a first burst disk nozzle of the jetting tool following significant perforating application wear.
Figure 4B:
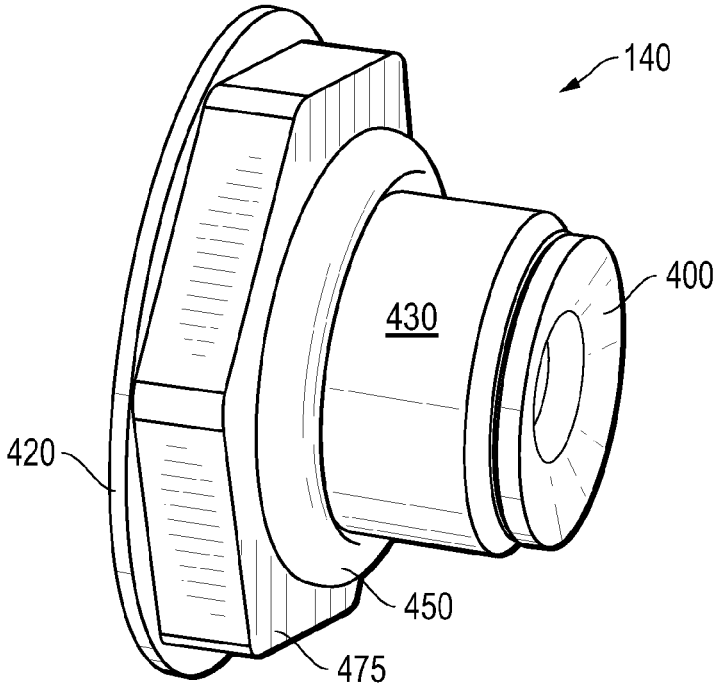
FIG. 4B is a perspective view of a second burst disk nozzle of the jetting tool prior to use in a perforating application.

Referring now to FIGS. 4A and 4B, with added reference to FIG. 1, perspective views of nozzles 120, 140 are depicted. More specifically, the downhole nozzle 120 is depicted following a series of perforation applications which have inflicted a certain natural degree of damage 401. The uphole nozzle 140, on the other hand, remains in-tact and in an unused condition as detailed further below. Such nozzles 120, 140 define a channel 410, generally ranging between about 0.10 and 0.25 inches in diameter. Further, both nozzles 120, 140 are equipped with an exposed cover 420 that transitions into a main body 475 and seal 450 coupled to a cylinder housing 430 that surrounds the nozzle channel 410. However, the uphole nozzle 140 is also outfitted with a burst disk 400 as detailed further below.

Continuing with specific reference to FIG. 4A, as sand-based perforating fluids are jetted out of the nozzle channel 410, erosion begins to take place at defining surfaces of this channel 410 and the nozzle cover 420. Indeed, even where durable carbide-based materials are utilized, such erosion may be expected after some period of use. Further, once begun, the degree of erosion may increase exponentially with each successive perforating application via the nozzle 120. Ultimately, the effectiveness of the nozzle 120 for sake of perforating may be reduced or negligible. However, as noted above, the unused uphole nozzle 140 remains incorporated with the tool 101 (of FIG. 1).

Referring now to FIG. 4B, the downhole nozzle 140 is equipped with a burst disk 400 as noted above. So, for example, the interior of this nozzle 140 is not exposed to jetting fluids. Thus, perforating-based wear at its interior channel or cover surface 420 is unseen as in the case of the downhole nozzle 120 (e.g. at 401). By the same token, however, this nozzle 140 is unavailable for use in abrasive jetting for sake of perforating as detailed hereinabove. Nevertheless, as detailed below, once the downhole nozzle 120 is rendered ineffective as shown in FIG. 4A, it may be closed off and the burst disk 400 of the uphole nozzle 140 ruptured, such that a new nozzle 140 is available for operations. More specifically, the disk 400 may be of a predetermined pressure rating. Therefore, rupturing of the disk 400 in this manner may be a matter of applying a correspondingly predetermined pressure through the tool 101 of FIG. 1. As such, the need to remove the entire assembly 100 of FIGS. 1 and 2 in order to redress an inoperable nozzle is obviated, thereby saving considerable downhole time and expense.

Figure 5A:
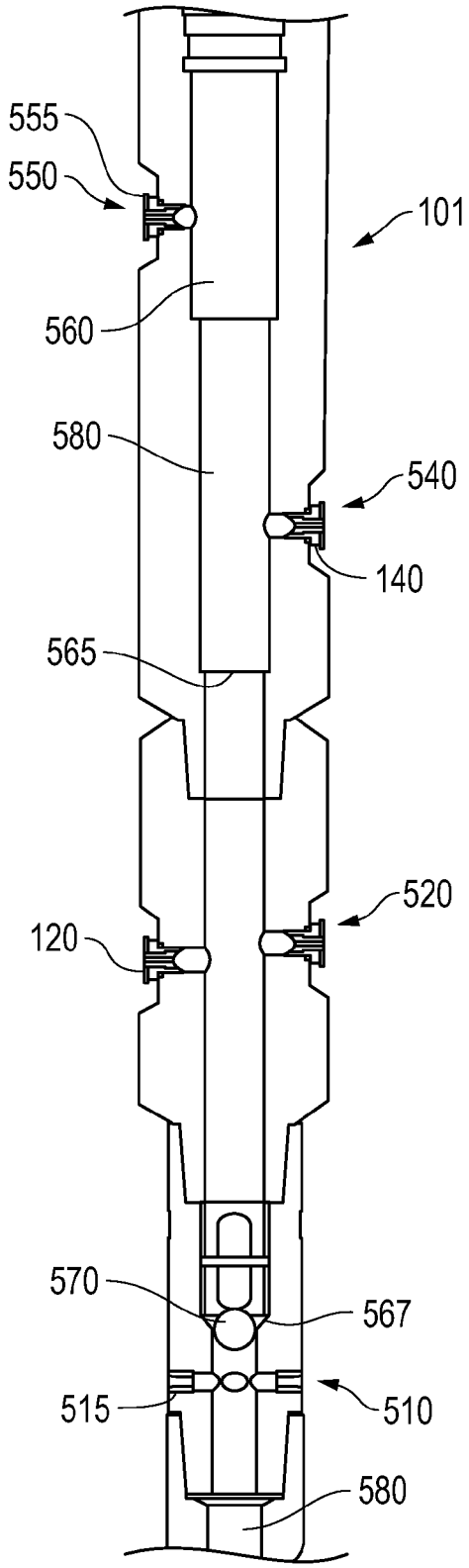
FIG. 5A is a side cross-sectional view of the jetting tool at the outset of downhole perforating applications.
Figure 5B:
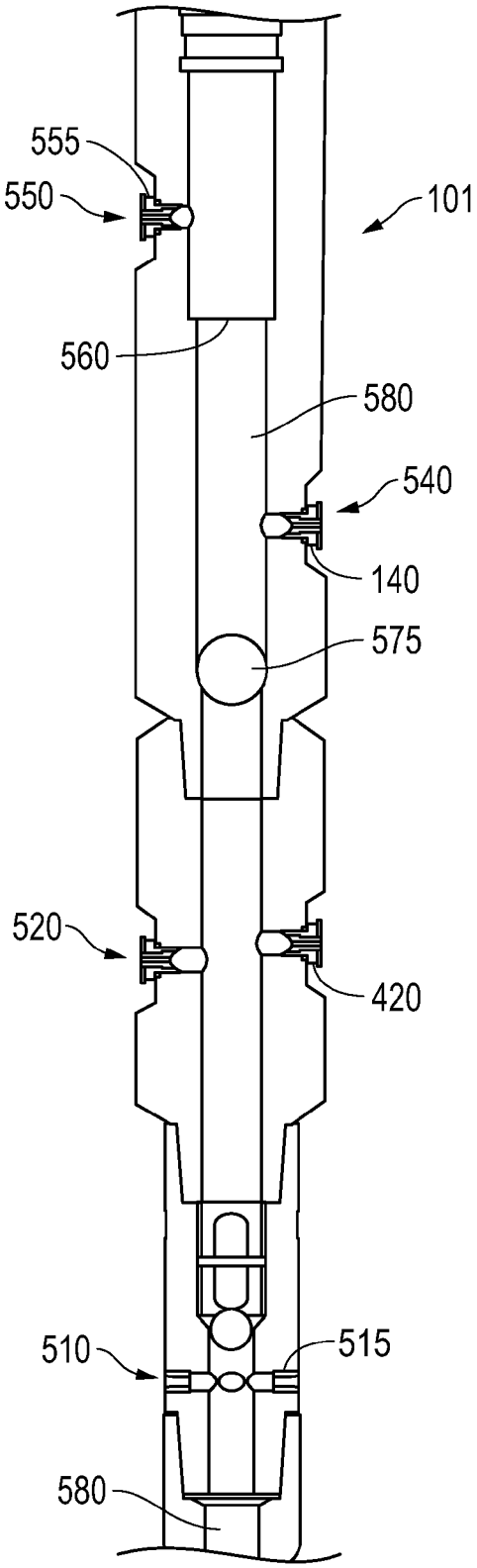
FIG. 5B is a side cross-sectional view of the tool of FIG. 5A employing subsequent burst disk nozzle selection following wear-out of prior nozzles.

Referring now to FIGS. 5A and 5B, side cross-sectional views of the jetting tool 101 of FIGS. 1 and 2 are depicted. More specifically, FIG. 5A is a view of the tool 101 at the outset of perforating applications where fluid access to downhole nozzles 420 is available for sake of abrasive jetting. FIG. 5B, on the other hand reveals closed off fluid access to these nozzles 420 via a pressure technique that also results in the burst disk opening of the uphole nozzles 420.

With more direct reference to FIG. 5A, the tool 101 includes a central tool channel 580 that is in fluid communication with coiled tubing 110 as depicted in FIGS. 1 and 2. In the embodiment shown, a ball projectile 570 may be introduced to the channel 580 and pumped to an initial valve seat 567 as a conventional manner by which to initiate perforating through initial nozzles 515 at an initial depth 510. By the same token, depending on pressure through the channel 580 perforating at the downhole depth 520 via downhole nozzles 120 may also ensue.

Continuing with reference to FIG. 5A, uphole 140 and further uphole 555 nozzles may remain sealed off via burst disks 400 as described hereinabove at FIG. 4B. For example, these uphole nozzles 140, 555 may be outfitted with disks 400 having a rating that exceeds 3,000 PSI whereas the perforating application taking place through the downhole 120 and initial 515 nozzles occurs at a differential of below about 2,500 PSI.

With specific reference now to FIG. 5B, the above noted downhole 120 and initial 515 nozzles may wear out over the course of successive perforating applications as detailed above. Therefore, a subsequent projectile ball 575 of greater diameter than the first 570 may be introduced into the channel 580. As shown, the ball 575 is sized to sealably encounter a sealing location of a subsequent valve seat 565 located between the uphole 140 and downhole 120 nozzles. Thus, once the ball 575 is sealingly engaged with the seat 565, the damaged valves 120, 515 therebelow are effectively shut off. Once more, flow may be directed through the channel 580 such that a pressure exceeding the predetermined amount, 3,000 PSI in the example noted above, may be produced. As such, the disk 400 of the uphole nozzle 140 may be burst open and utilized in continuing perforating operations. In this manner, a new nozzle 140 is made available to the tool 101 without the need for tool removal from the well 280 during ongoing operations (see FIG. 2). Once more, the providing of a new nozzle 140 is done in a manner that does not require movement or shifting of downhole tool components. This may be of particular advantage where more abrasive perforating fluids are utilized which may tend to inflict wear and sticking on such components.

The above detailed technique for equipping and utilizing successive sets of nozzles 120, 140 may be continued to any practical number of depths 510, 520, 540, 550. For example, as shown in FIGS. 5A and 5B, a further uphole nozzle 555 is shown which may be burst disk protected to a pressure of more than about 4,000 PSI. Furthermore, where multiple burst disk nozzles 140 are positioned at roughly the same depth location for simultaneous use, the bursting of multiple disks 400 may be operator ensured by increasing flow rate through the channel 580 as necessary. For example, where pressure feedback at surface is indicative of a single burst where multiple bursts are called for at a given location, flow rate may be increased as a manner of overrunning burst capacity of the other nozzle's disk.

Figure 6:
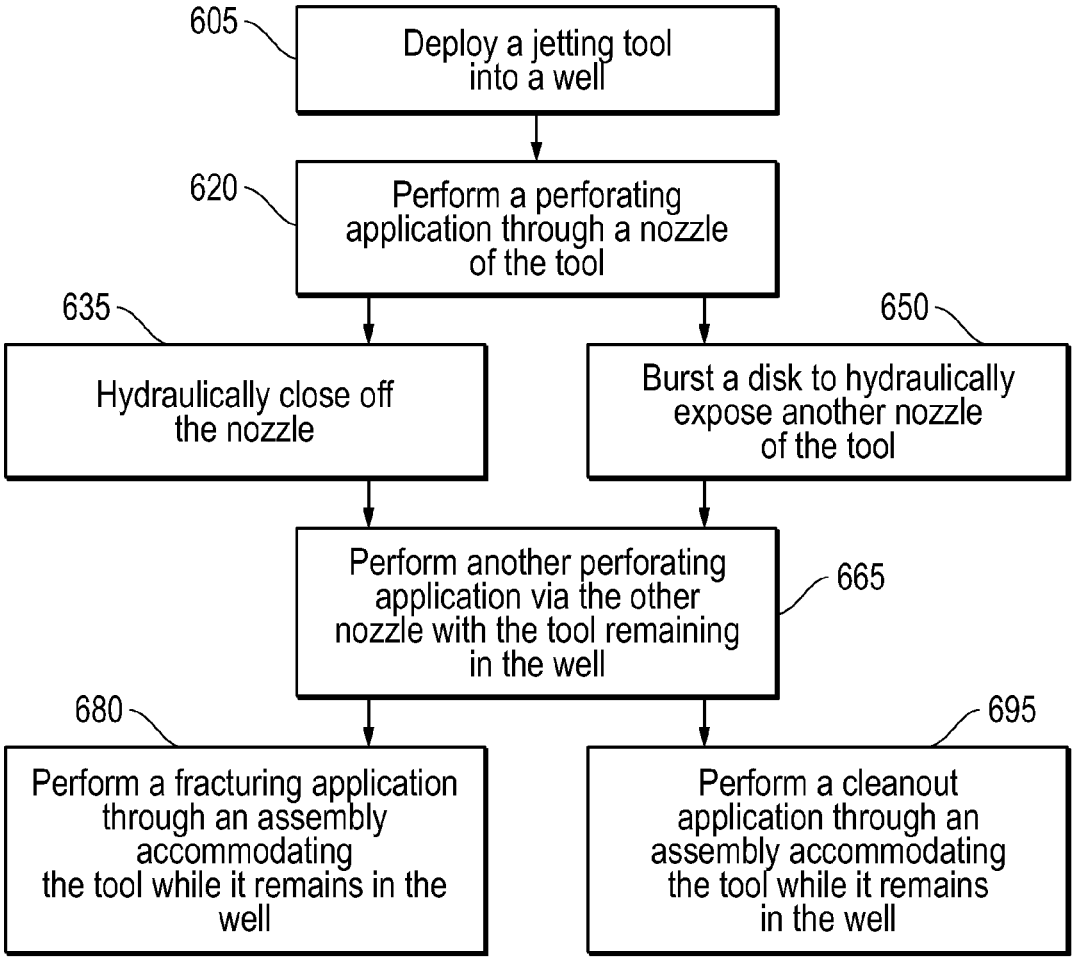
FIG. 6 is a flow-chart summarizing an embodiment of employing a nozzle selective perforating jet assembly in a well.

Referring now to FIG. 6, a flowchart is depicted summarizing an embodiment of employing a nozzle selective perforating jet assembly in a well. More specifically upon deployment into the well as indicated at 605, an initial series of perforating applications may be run as indicated at 620. However, upon wear at initial nozzles, they may be hydraulically sealed off (see 635). Indeed, in embodiments hereinabove, the same techniques for closing off the initial nozzle(s) may support increasing pressure to burst a disk as noted at 650. Thus, subsequent nozzle(s) may be exposed for subsequent perforating as indicated at 665. In addition to leaving the tool in the well during the transition from a worn set of nozzles to a fresh set, as indicated at 680 and 695, fracturing, cleanout and other applications may also ensue via the same assembly accommodating the tool without requirement of its removal from the well.

Embodiments described hereinabove allow for jetting tool perforating applications in a manner that substantially extends the life of the tool. More specifically, the tool need not be removed and repaired after every 5 to 10 jetting perforating applications. Indeed, any practical number of perforating applications may be directed through the same jetting tool without requirement of intervening remedial action. Such is limited only by the design constraints employed such as varying burst pressure ratings, tool channel and projectile ball diameters and other factors. Regardless, operators need not attempt to ineffectively drive pressures up to extend the nozzle life but rather are provided with a viable technique for leaving the tool downhole while moving on from a worn nozzle to a fresh one for subsequent perforating.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, the burst disk concepts described herein may be employed in a contingency fashion so as to allow operator directed nozzle use in circumstances apart from perforating. These circumstances may include unsticking a tool, introducing annular circulation or dealing with a variety of other emergent circumstances. Furthermore, the foregoing description should not be read as pertaining only to the precise structures described and shown in the accompanying drawings, but rather should be read as consistent with and as support for the following claims, which are to have their fullest and fairest scope.

We claim:

1. A nozzle selective jetting tool comprising:

a first jetting nozzle at a first location of the tool for a first perforating application;

a second jetting nozzle at a second location of the tool for a subsequent perforating application;

a burst disk coupled to said second nozzle for occluding access thereto when pressure in a central channel of the tool is below a predetermined level; and an anchor segment for anchoring the tool in advance of the perforating applications.

2. The tool of claim 1 further comprising a sealing location in the central channel and between said nozzles for sealably accommodating a projectile to close channel access to said first nozzle and to raise the pressure above the predetermined level for the subsequent perforating application.

3. The tool of claim 2 wherein said sealing location is a valve seat and the projectile is a ball.

4. The tool of claim 1 wherein the first perforating application takes place at a pressure below that of the subsequent perforating application.

5. The tool of claim 1 wherein said first nozzle is located downhole of said second nozzle when the tool is positioned in a well for the perforating applications.

6. A hydraulic bottom hole tool assembly for disposal in a well, the assembly comprising:

a jetting perforating tool for perforating a wall of the well and accommodating first and second selectively employable nozzles, at least one of the nozzles having a burst disk for allowing hydraulic access thereto via a central channel of the tool when channel pressure therein exceeds a predetermined level;

a hydraulic line conveyance in fluid communication with the central channel for directing an application through the other nozzle when channel pressure therein is below the predetermined level; and an anchor segment.

7. The assembly of claim 6 wherein the predetermined level is a first predetermined level, the assembly further comprising a third nozzle of said tool having another burst disk for allowing hydraulic access thereto via the central channel when pressure therein exceeds a second predetermined level greater than the first predetermined level.

8. The assembly of claim 6 wherein said hydraulic line conveyance is selected from a group consisting of coiled tubing and drill pipe.

9. The assembly of claim 6 wherein the wall is selected from a group consisting of a casing, a liner and an open-hole formation.

10. The assembly of claim 6 further comprising:

a reverse circulation segment.

11. The assembly of claim 6 wherein said anchor segment includes a compression set anchor for anchoring the assembly in advance of perforating.

12. The assembly of claim 6 further comprising a segment selected from a group consisting of a swivel, an eccentric weight and an isolation device.

13. A method of selectively employing jetting nozzles of a tool disposed in a well at an oilfield, the method comprising:

providing a tool having a first nozzle, a second nozzle, and a reverse circulation segment;

performing a hydraulic application through a first nozzle at a first location of the tool;

hydraulically closing off access to the first nozzle;

bursting a rupture disk of a second nozzle at a second location of the tool; and performing a second hydraulic application through the second nozzle.

14. The method of claim 13 further comprising initiating a ball drop technique from a surface of the oilfield to initiate said closing and said bursting.

15. The method of claim 13 wherein the applications are perforating applications directed at a wall of the well.

16. The method of claim 13 wherein at least one of the applications is directed at a contingent emergent circumstance.

17. The method of claim 13 further comprising performing a fracturing application through an assembly accommodating the tool while the tool remains in the well.

18. The method of claim 13 further comprising performing a cleanout application through an assembly accommodating the tool while the tool remains in the well.

19. The method of claim 18 wherein performing a cleanout application through the assembly comprises utilizing the reverse circulation segment.

20. The method of claim 13 wherein providing a tool further comprises providing a tool with an anchor segment and further comprising anchoring the tool in advance of the hydraulic applications.

21. The method of claim 13 wherein the first hydraulic application takes place at a pressure below that of the subsequent hydraulic application.

* * * * *